US009950409B2

(12) United States Patent
Grobbel et al.

(10) Patent No.: US 9,950,409 B2
(45) Date of Patent: Apr. 24, 2018

(54) CLAMPING DEVICE WITH REMOVABLE HANDLES

(71) Applicant: Delaware Capital Formation, Inc., Wilmington, DE (US)

(72) Inventors: Thomas M. Grobbel, Ortonville, MI (US); Ken Hagan, Eastpointe, MI (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 15/017,966

(22) Filed: Feb. 8, 2016

(65) Prior Publication Data

US 2016/0243676 A1 Aug. 25, 2016

Related U.S. Application Data

(60) Provisional application No. 62/120,538, filed on Feb. 25, 2015.

(51) Int. Cl.

| | |
|---|---|
| ***B25B 5/16*** | (2006.01) |
| ***B25B 5/04*** | (2006.01) |
| ***B25B 23/00*** | (2006.01) |
| ***B25B 5/12*** | (2006.01) |
| *B25B 7/12* | (2006.01) |

(52) U.S. Cl.

CPC ..... *B25B 5/16* (2013.01); *B25B 5/04* (2013.01); *B25B 5/12* (2013.01); *B25B 23/0035* (2013.01); *B25B 7/123* (2013.01); *Y10T 279/17752* (2015.01); *Y10T 279/17786* (2015.01)

(58) Field of Classification Search

CPC ..... B25B 13/26; B25B 5/125; B25B 5/16; B25B 5/00; B25B 23/0035; B25B 7/123; B25B 5/12; B25B 7/02; B25B 5/04; Y10T 279/17752; Y10T 279/17786; B23B 31/1071

USPC ..... 279/2.23, 2.24, 22, 75, 905, 30, 79; 81/738, 438, 345; 403/20, 266; 269/261, 269/143, 201, 216, 249, 6, 228; 29/243.53–243.58; 294/106

See application file for complete search history.

(56) References Cited

U.S. PATENT DOCUMENTS

| | | | | |
|---|---|---|---|---|
| 2,327,368 A | | 8/1943 | Olson | |
| 2,374,899 A | | 5/1945 | Sasgen | |
| 2,490,923 A | | 12/1949 | Sasgen | |
| 2,817,254 A | * | 12/1957 | Barnes | B23K 20/028 228/3.1 |
| 2,894,547 A | | 7/1959 | Lampe | |
| 3,096,975 A | | 7/1963 | Irwin | |
| 4,897,014 A | * | 1/1990 | Tietze | B25J 15/0206 279/2.23 |

(Continued)

FOREIGN PATENT DOCUMENTS

DE 102014115432 A1 * 10/2014

*Primary Examiner* — Christopher M Koehler
*Assistant Examiner* — Mahdi H Nejad
(74) *Attorney, Agent, or Firm* — Harness, Dickey & Pierce, P.L.C.

(57) ABSTRACT

A clamping device has a clamp and a removable handle. A pair of clamping arms is on the clamp. A pivoting device includes a clamp bushing linked with each of the clamping arms of the pair of clamping arms to move the pair of arms between an opened and closed position. The removable handle couples with the clamp bushing. The removable handle includes a release mechanism to actuate the pivot mechanism to move the clamping arms between the open and clamped positions.

9 Claims, 9 Drawing Sheets

(56) References Cited

U.S. PATENT DOCUMENTS

| | | | | |
|---|---|---|---|---|
| 5,676,500 | A | 10/1997 | Sommerfeld | |
| 6,240,815 | B1 | 6/2001 | Huang | |
| 6,276,039 | B1 | 8/2001 | Barnes | |
| 6,966,550 | B2 | 11/2005 | Marks | |
| 6,993,999 | B2 | 2/2006 | Wong | |
| 7,090,209 | B1 | 8/2006 | Rowlay | |
| 7,107,881 | B1 | 9/2006 | Liou | |
| 7,389,978 | B2 | 6/2008 | Rowlay et al. | |
| 7,604,224 | B2 | 10/2009 | Rowlay et al. | |
| 7,730,811 | B2 | 6/2010 | Robinson et al. | |
| 8,025,279 | B2 | 9/2011 | Seber | |
| 8,137,379 | B2 | 3/2012 | Labash | |
| 8,469,343 | B2 | 6/2013 | Clark | |
| 8,475,076 | B2 * | 7/2013 | Yamashita | B25B 13/06 403/322.2 |
| 8,534,729 | B2 * | 9/2013 | Wilkinson | B25J 15/024 294/106 |
| 8,714,570 | B2 | 5/2014 | Skijus et al. | |
| 8,740,208 | B2 * | 6/2014 | Hagan | B25B 5/12 269/143 |
| 2011/0101629 | A1 * | 5/2011 | Wienhold | B25B 23/0035 279/79 |
| 2011/0175270 | A1 * | 7/2011 | Hagan | B25B 5/12 269/6 |
| 2013/0023883 | A1 * | 1/2013 | Wright | A61B 17/158 606/88 |
| 2014/0041971 | A1 * | 2/2014 | Hujer | B62L 1/16 188/72.7 |
| 2014/0234069 | A1 | 8/2014 | Skijus et al. | |
| 2015/0102567 | A1 * | 4/2015 | Chan | B25B 23/0035 279/75 |
| 2016/0299015 | A1 * | 10/2016 | Schmier, II | G01L 1/06 |

* cited by examiner

CLAMPING DEVICE WITH REMOVABLE HANDLES

CROSS-REFERENCE TO RELATED APPLICATION

This application claims the benefit of U.S. Provisional Application No. 62/120,538, filed on Feb. 25, 2015. The entire disclosure of the above application is incorporated herein by reference.

FIELD

The present disclosure relates to clamping and, more particularly, to a clamping device with a removable handle.

BACKGROUND

When clamping workpieces with manual clamps, ordinarily the clamps have handles that extend beyond the workpiece. The user is required to be present around the clamped workpiece conducting other operations. Since the handles project beyond the workpiece, the handles are constantly in the way of the user as he moves about the workpiece. Ordinarily, the handles are bumped or nudged requiring realignment of the clamping device. In some instances, the clamp may be bumped so that it is removed from the workpiece causing additional work to be conducted onto the workpiece. Additionally, the overhang of the handles adds additional weight which increases the moment/torque on the workpiece. Thus, it is possible to cause distortion on thin workpiece structures.

However, the handles are an important part of the clamp. The handles provide leverage to open the clamp so that the clamp may apply a greater force onto the workpiece. The longer the handles, the less force required to open the clamps and generally the larger the force applied by the clamps onto the workpiece.

Accordingly, while handled clamps serve a vital purpose, it is desirable to move the handles out of the way so that the handles are not bumped, contacted, or otherwise interfered with by the user while the user is conducting work around the workpiece.

U.S. Pat. No. 8,740,208, assigned to the assignee of the present disclosure, provides a clamping system with a removable handle. The handle enables the clamp to be applied to the workpiece. The handle is then removed from the clamp so that the handles do not interfere with the user or other materials during manipulation of the workpiece. While the patent works satisfactorily, designers are always striving to improve the art.

SUMMARY

According to a first aspect of the disclosure, a clamping device with a removable handle comprises a pair of clamping arms. A pivot device is coupled with the pair of clamping arms. The pivot device includes a clamp bushing linked with each of the clamping arms of the pair of clamping arms. The pivoting device moves the pair of arms between an opened and a clamped position. A removable handle is coupled with the clamp bushing. The removable handle includes a release mechanism to activate the pivot mechanism. During activation, the clamping arms are moved between an opened and clamped position.

The bushing further includes a polygonal inner wall to receive the handle. The handle includes a spigot with a ball lock for engaging and disengaging the pivot mechanism. The spigot has a polygonal portion in the area of the ball lock to mate with the polygonal portion of the pivot mechanism. The release mechanism includes a pivot lever coupled with a sliding bushing. The sliding bushing engages the pivot mechanism clamp bushing. The pivot lever is moved between a first and second position. This moves the clamp and sliding bushings between the first and second position which, in turn, moves the arms between an open and clamped position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Example embodiments will now be described more fully with reference to the accompanying drawings.

Figure 3:
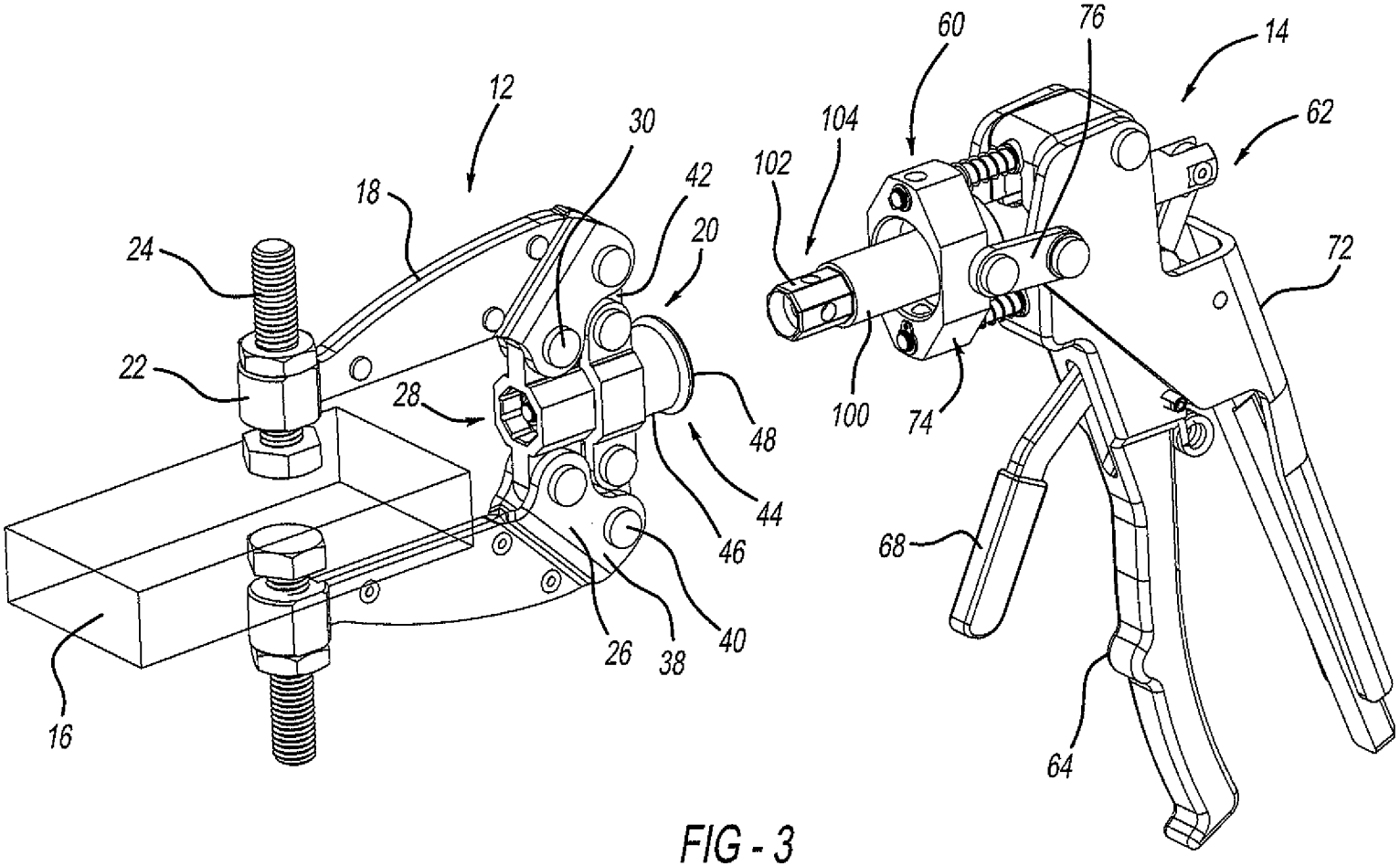
FIG. 3 is a perspective view of the clamping device with the handle removed.
Figure 4:
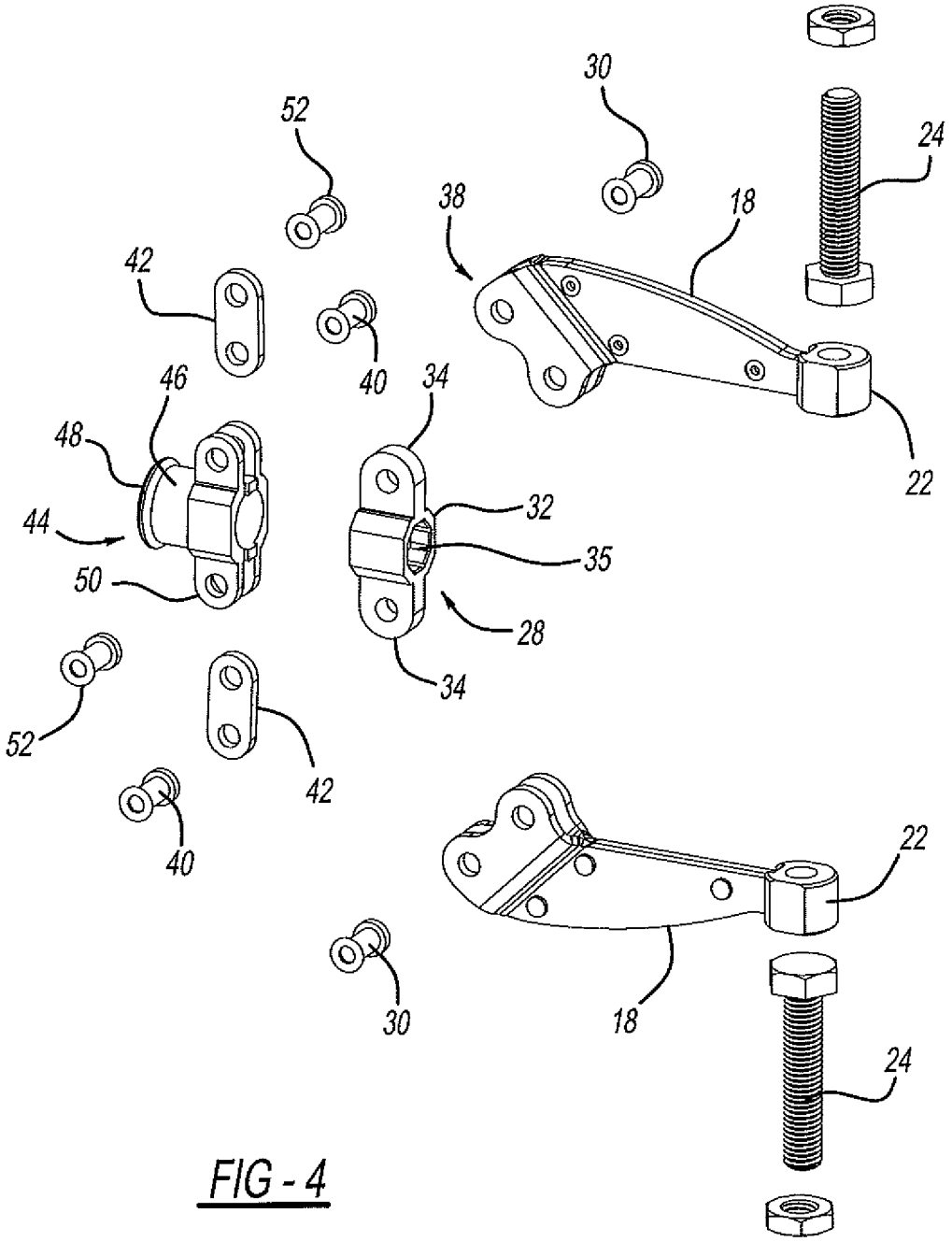
FIG. 4 is an exploded perspective view of the clamp arms.
Figure 5:
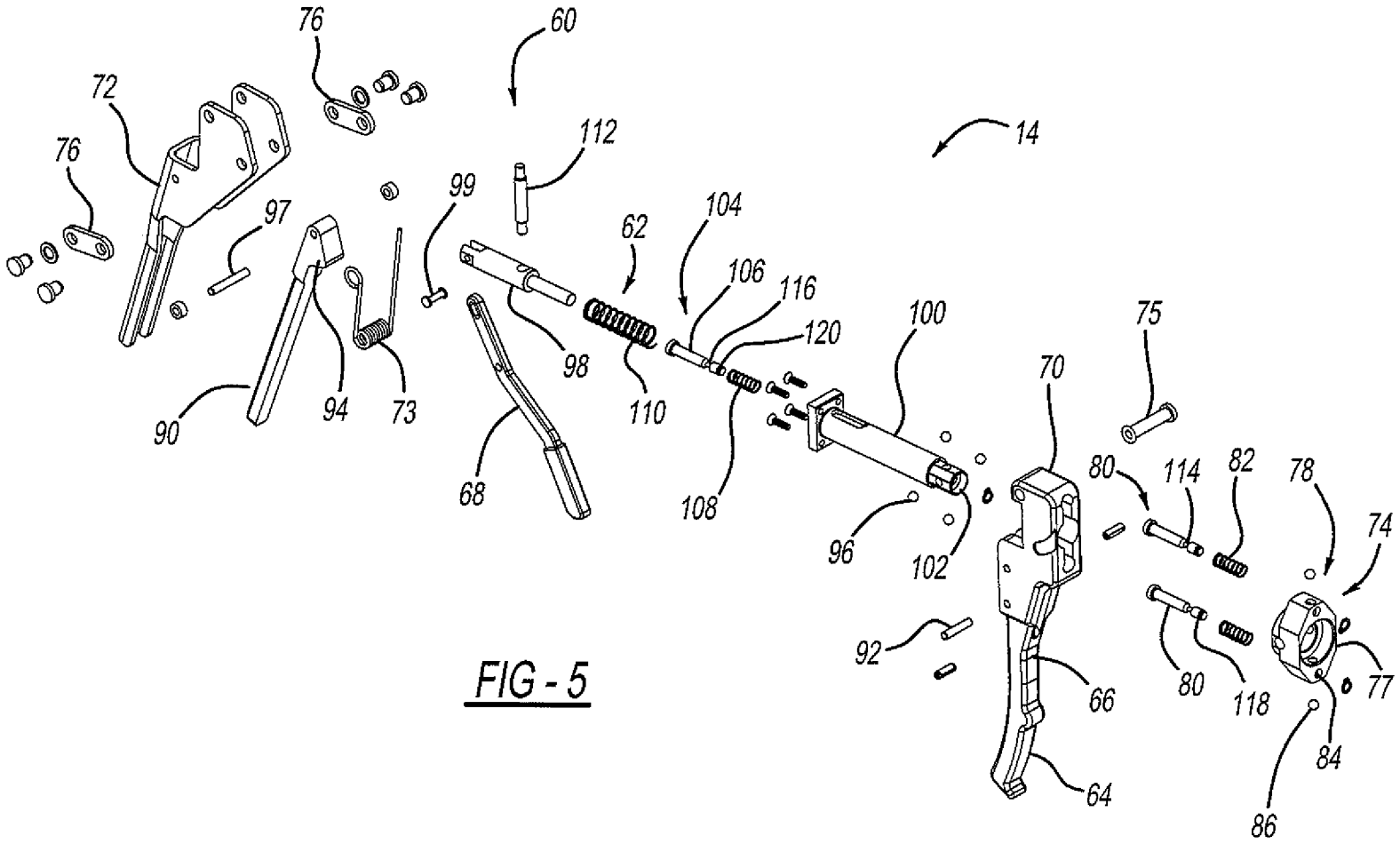
FIG. 5 is an exploded perspective view of the removable handle.
Figure 6:
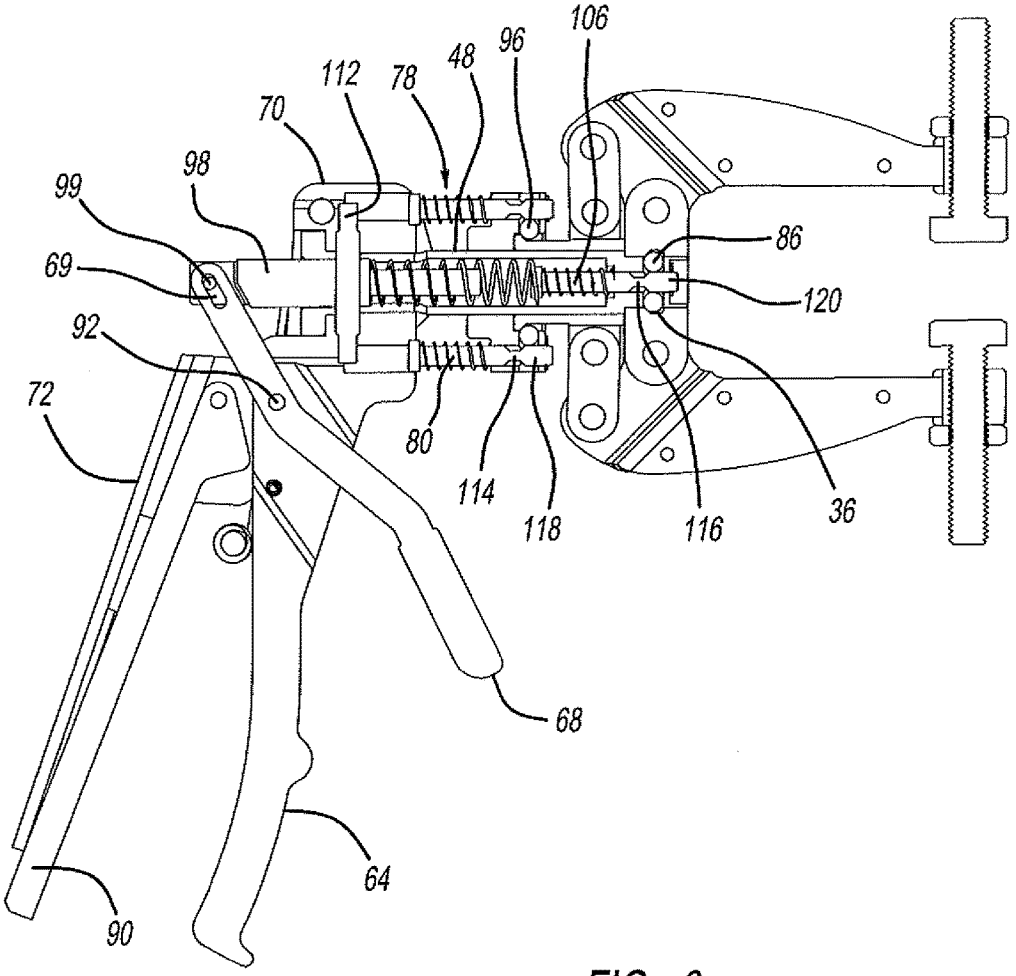
FIG. 6 is a cross-section view of FIG. 1.
Figure 7:
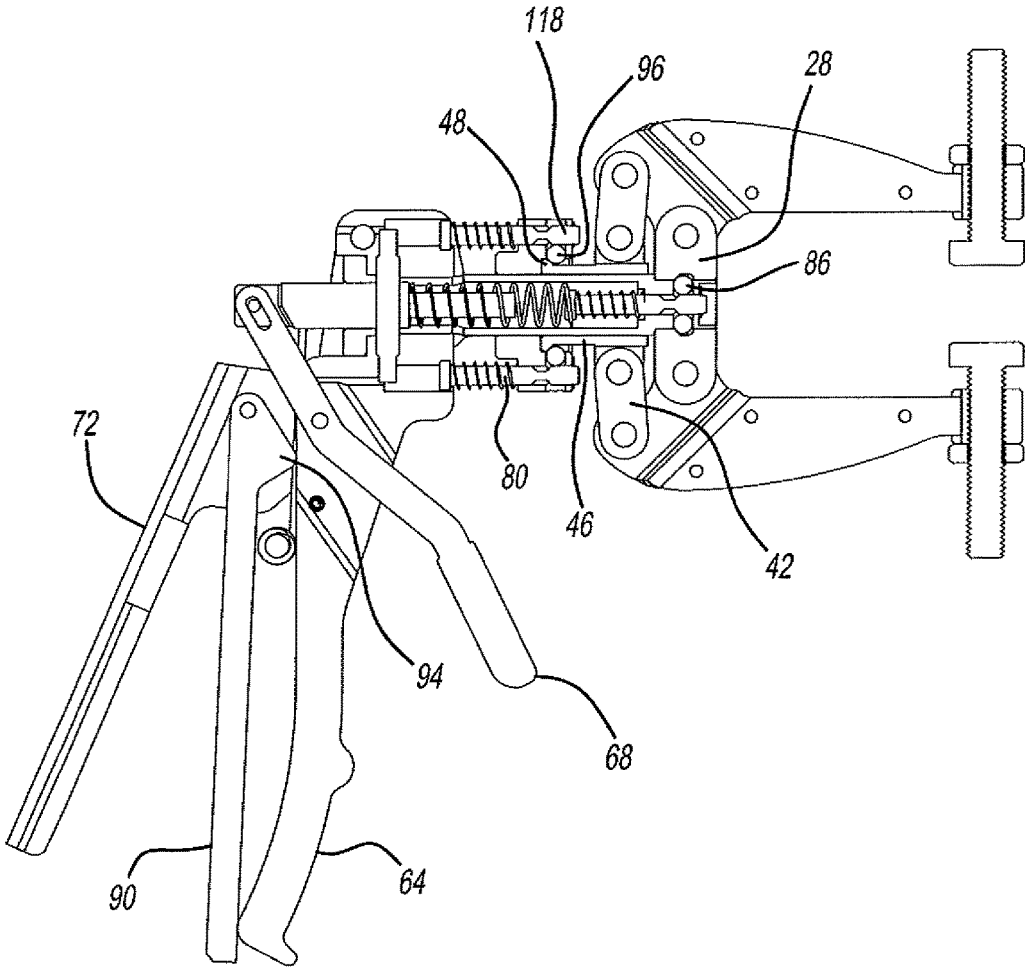
FIG. 7 is a cross-section view like FIG. 6 in an intermediate position.
Figure 8:
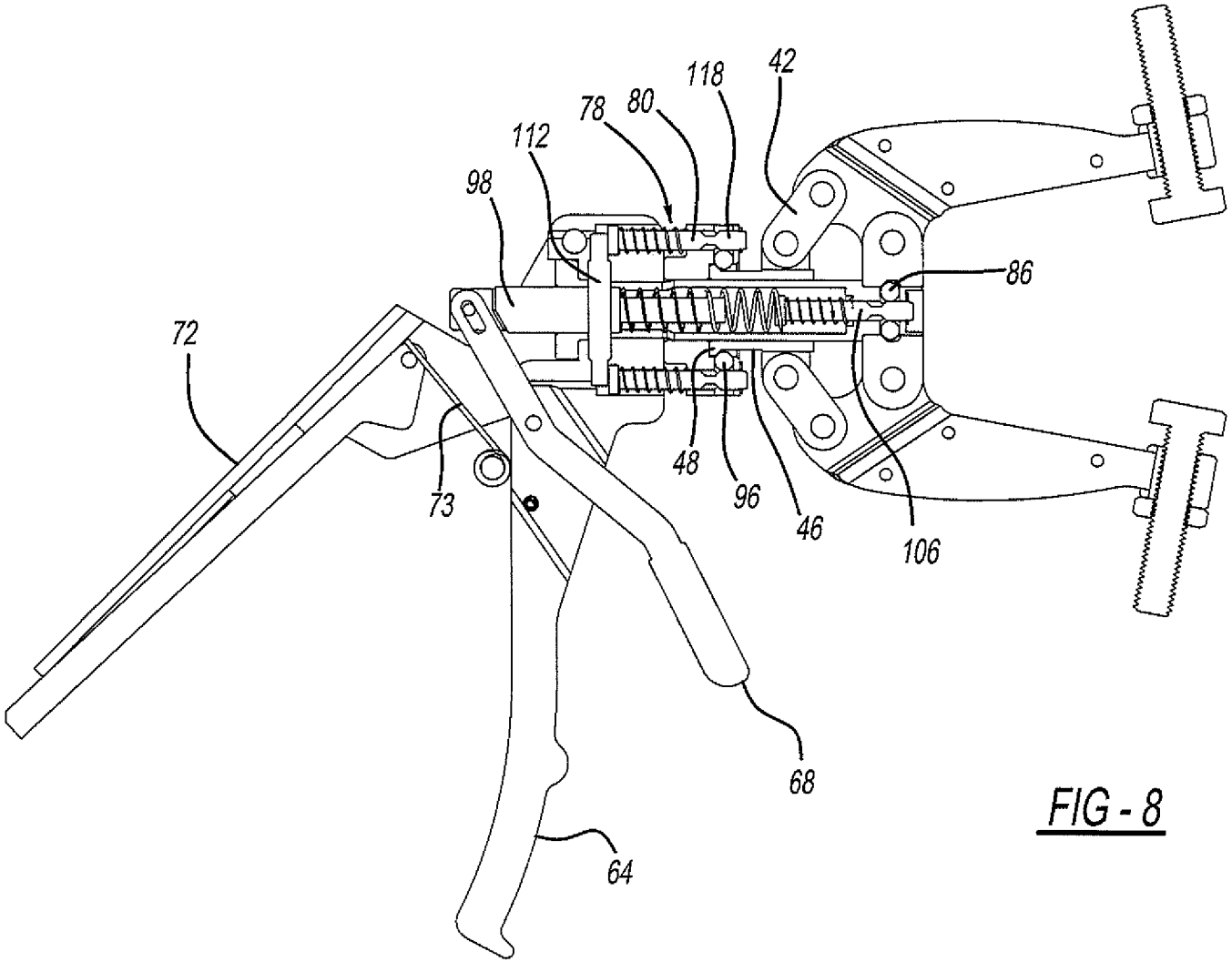
FIG. 8 is a cross-section view of FIG. 1 in an open position.
Figure 9:
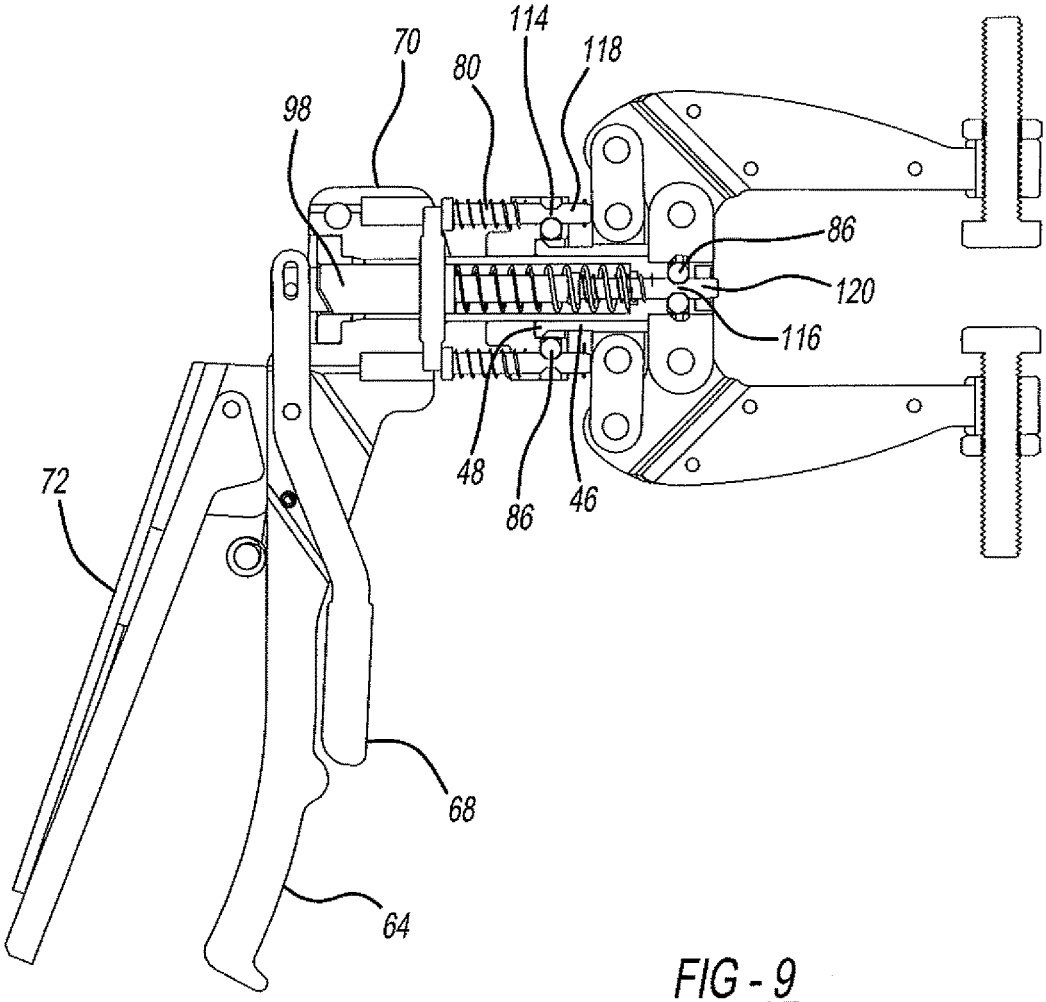
FIG. 9 is a view like FIG. 8 with a handle in a disengaged position.

Turning to the figures, a clamping device is illustrated and designated with the reference numeral 10. The clamping device 10 includes a clamp 12 and a removable handle assembly 14. The clamp 12 is illustrated clamped to a workpiece 16. FIG. 3 illustrates the handle assembly 14 removed from the clamp 12. FIGS. 4 and 5 illustrate exploded views of the clamp 12 and handle assembly 14.

The clamp 12 includes a pair of arms 18. The arms 18 are joined at one end by a pivot mechanism 20. The arms 18 are identical and have a threaded collar 22 to receive a set screw 24. The other end of the arm includes a clevis 26 to attach the arms to a fulcrum member 28. The arms 18 include apertures that receive pins 30 that pass through apertures in the fulcrum member 28 to enable the arms 18 to pivot with respect to the fulcrum member 28 from an open to a closed position.

The fulcrum member 28 includes a body 32 with a pair of arms 34. The arms 34 include apertures that receive the pins 30. The body 32 has a hollow configuration. The interior surface 35 of the cylinder has a polygonal configuration and is shown as a hexagonal configuration. This enables the removable handle assembly 14 to be positioned at different angles with respect to the clamp 12. Additionally, the interior surface 35 includes a ball groove 36 that receives balls from the handle assembly ball lock 104 to lock the handle assembly 14 with the clamp 12.

The arms 18 include a clevis end 38 that includes an aperture to receive pins 40. Links 42 are secured to the arms 18 via the pins 40. The links 42 are coupled with the clamp bushing 44. The clamp bushing 44 has a hollow right cylinder body 46 that terminates at a flange 48. The clamp bushing 44 also includes a pair of arms 50 that include apertures to receive pins 52. The pins 52 also couple with the links 42 to secure the clamp bushing 44 with the arms 18.

The handle assembly 14 includes a release mechanism 60 that, when coupled with the clamp 12, moves the clamp 12 between its open and clamped position. The handle assembly 14 includes an engagement mechanism 62 to engage and disengage the handle assembly 14 with the clamp 12 in a locked and removed position.

The handle assembly 14 includes a grip 64. The grip 64 includes a slot 66 that enables a trigger member 68 of the engagement mechanism 62 to pass through the grip 64. Also, the grip 64 includes a housing portion 70 that includes apertures for passage of the release mechanism 60 and engagement mechanism 62.

Figure 1:
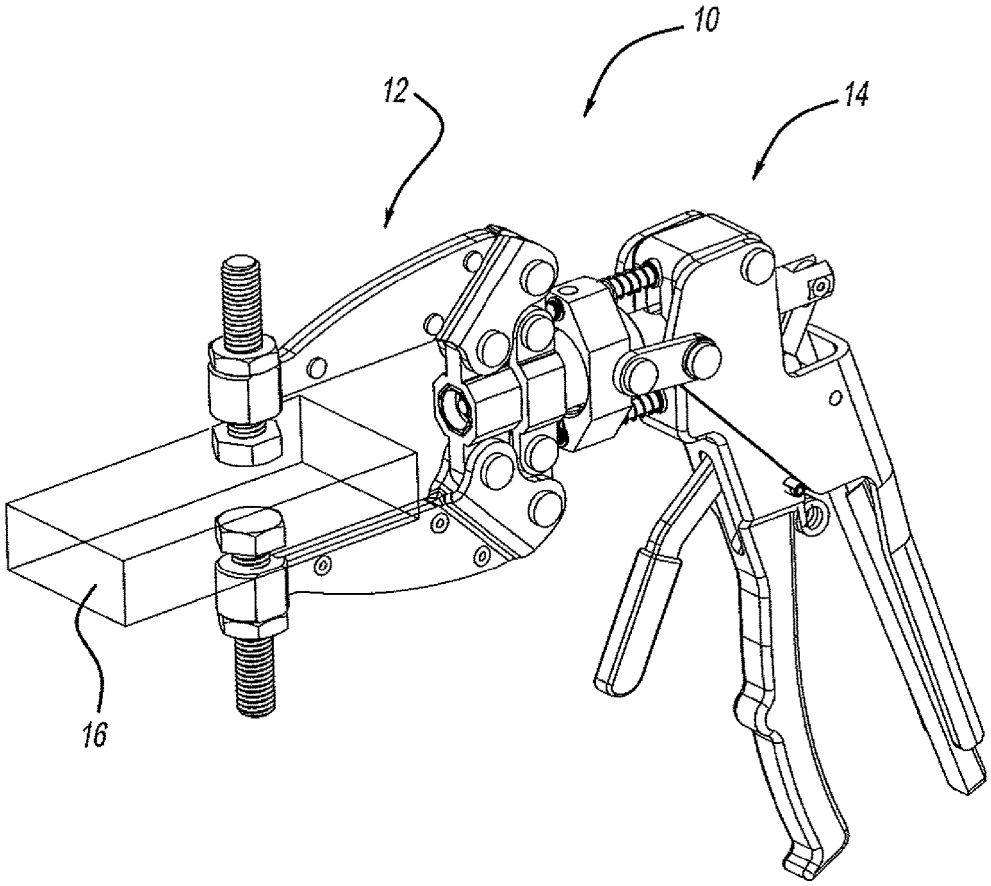
FIG. 1 is a perspective view of the clamping device.

The release mechanism 60 includes a squeeze lever 72 pivotably coupled, via pin 75, with the grip housing portion 70. The squeeze lever 72 moves between a first and second position. It is illustrated in a closed position in FIGS. 1 and 3 and in normally open position in FIG. 2. A spring 73 keeps the squeeze lever 72 in its normally open position. The squeeze lever 72 is coupled with a slide bushing 74 via links 76. The links 76 are pinned to the squeeze lever 72 as well as the slide bushing 74. The slide bushing 74 includes a body 77 as well as a ball lock mechanism 78. The ball lock mechanism 78 includes a pair of ball lock expanders 80 that are biased by springs 82 through apertures 84 in the body 77. The ball lock expanders 80 work with the balls 96 to lock and unlock the sliding bushing 74 with the clamp bushing 44 about the flange 48.

Figure 2:
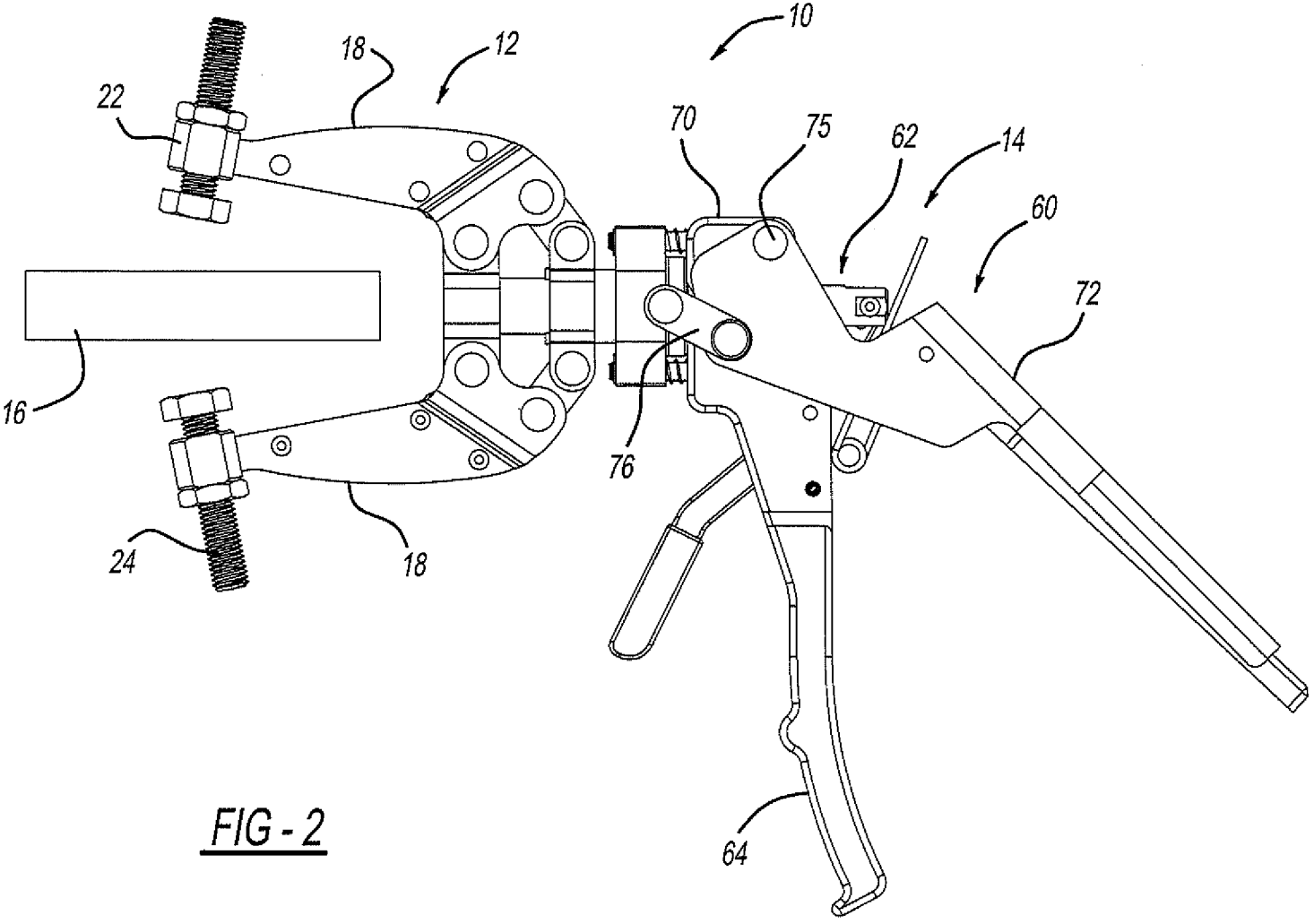
FIG. 2 is an elevation view of the clamping device of FIG. 1

A release lever 90 is pivotally secured, via a pin 97, in the squeeze lever 72. The release lever 90 includes a cam portion 94 that abuts against the grip 64. As the release lever 90 is pushed forward, the cam portion 94 pushes against the grip 64 moving the squeeze lever 72 away from the grip 64. The spring 73 then moves the squeeze lever 72 into its open position to move the clamp 12 to an open position as seen in FIG. 2.

The engagement mechanism 62 includes trigger member 68 pivoted via pin 92 on the grip 64. The end of the trigger member 68 includes a slot 69 to secure with a plunger 98 via a pin 99. The plunger 98 moves within a spigot 100 that extends from the handle assembly 14. The spigot 100 includes a polygonal end 102 that includes the ball lock mechanism 104. The polygonal end 102 mates with the polygonal interior 35 of the body 32. The spigot 100 also includes a ball lock expander 106 that is biased by spring 108. The plunger 98 is biased by spring 110 to move the trigger member 68 between a first and second position. Also, the plunger 98 includes a pin 112 that actuate the ball expanders 80.

To connect and disconnect the handle assembly 14 with the clamp 12, the trigger member 68 is pulled towards the grip 64. As this occurs, the plunger 98 moves in the spigot 100. As this occurs, the pin 112 contact the ball lock expanders 80 and the end of the plunger 98 contacts ball lock expander 106. As this happens, the grooves 114, 116 of the ball lock expanders 80, 106 are aligned with the balls 86, 96 enabling the balls 86, 96 to move into the grooves 114, 116. Thus, the balls 86, 96 of the ball lock mechanisms 78, 104 move into the grooves 114, 116. This enables the handle assembly 14 to be inserted into the pivot mechanism clamp bushing 44 or to be removed from it.

Once the handle assembly 14 is coupled with the clamp bushing 44, the trigger member 68 is released. The trigger member 68 moves towards the housing portion 70 of the grip 64. This enables the spring 110 to bias the plunger 98 away from the clamp 12. As this occurs, the cylinder portions 118, 120 of the ball lock expanders 80, 106 come into contact with the balls 86, 96 locking the ball 96 with the flange 48 and the ball 86 in the groove 36, respectively.

Thus, the clamp 12 and handle assembly 14 are connected with one another. With the squeeze lever 72 in an open position, as in FIG. 2, the squeeze lever 72 is moved towards the grip 64. As this occurs, the squeeze lever 72 pivots about pivot pin 75 which moves the linkage pins 76 which, in turn, moves the slide bushing 74 towards the clamp 12. As the slide bushing 74 moves towards the clamp 12, the clamp bushing 44 moves towards the fulcrum member 28. As this occurs, the clamp arms 18 move into a clamping position. The links 42 are in an overcenter position locking the clamping arms 18 in position.

To open the clamps 12, the release lever 90 is moved towards the grip 64. As this occurs, the cam portion 94 cams against the grip 64 to move the squeeze lever 72 away from the grip 64. The spring 73 then biases the squeeze lever 72 to its open position. As the squeeze lever 72 moves to an open position, the links 76 pull on the slide bushing 74. The slide bushing 74 is secured with the flange 48 of the clamp bushing 44, via the ball locks 86. This movement moves the clamp bushing 44 along spigot 100 away from the fulcrum member 28 which, in turn, moves the arms 18 into an open position. If desired, the clamp 12 can be removed from the handle assembly 14 by activating the trigger member 68 as explained above to disengage the handle assembly 14 from the clamp 12.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A clamping device with a removable handle comprising:

a pair of clamping arms;

a pivoting device including a clamp bushing linked with each clamping arm of the pair of clamping arms, the clamp bushing including a receiving bore, the clamp bushing moving toward and away from the clamping arms for moving the pair of clamping arms between an open and clamped position; and the removable handle configured to couple and decouple with the clamp bushing, the removable handle including a release mechanism including a portion passing through the bushing, the release mechanism actuating the pivoting device moving the clamping arms between the open and clamped positions and when the pair of clamping arms are in the clamped position, the pair of clamping arms remain in the clamped position after decoupling of the removable handle.

2. The clamping device of claim 1, wherein the pivoting device further includes a polygonal inner wall to receive the portion of the removable handle.

3. The clamping device of claim 1, wherein the removable handle includes a spigot with a ball lock for engaging and disengaging the pivoting device.

4. The clamping device of claim 3, wherein the spigot has a polygonal portion in the area of the ball lock.

5. The clamping device of claim 1, wherein the release mechanism includes a pivot lever coupled with a sliding bushing, the sliding bushing engaging the clamp bushing.

6. The clamping device of claim 5, wherein the pivot lever is moved between a first and second position moving the sliding bushing and the clamp bushing between a first position and a second position, in turn, moving the clamping arms between the open and clamped position.

7. A clamping device with a removable handle comprising:

a pair of clamping arms;

a pivoting device including a clamp bushing linked with each clamping arm of the pair of clamping arms for moving the pair of arms between an open and clamped position;

the removable handle configured to couple and decouple with the clamp bushing, the removable handle including a release mechanism for actuating the pivoting device moving the clamping arms between the open and clamped positions and when the pair of clamping arms are in the clamped position, the pair of clamping arms remain in the clamped position after decoupling of the removable handle; and the pivoting device further includes a polygonal inner wall to receive the removable handle.

8. A clamping device with a removable handle comprising:

a pair of clamping arms;

a pivoting device including a clamp bushing linked with each clamping arm of the pair of clamping arms for moving the pair of arms between an open and clamped position;

the removable handle configured to couple and decouple with the clamp bushing, the removable handle including a release mechanism for actuating the pivoting device moving the clamping arms between the open and clamped positions and when the pair of clamping arms are in the clamped position, the pair of clamping arms remain in the clamped position after decoupling of the removable handle; and the removable handle includes a spigot with a ball lock for engaging and disengaging the pivoting device.

9. A clamping device with a removable handle comprising:

a pair of clamping arms;

a pivoting device including a clamp bushing linked with each clamping arm of the pair of clamping arms for moving the pair of arms between an open and clamped position;

the removable handle configured to couple and decouple with the clamp bushing, the removable handle including a release mechanism for actuating the pivoting device moving the clamping arms between the open and clamped positions and when the pair of clamping arms are in the clamped position, the pair of clamping arms remain in the clamped position after decoupling of the removable handle; and the release mechanism includes a pivot lever coupled with a sliding bushing, the sliding bushing engaging the clamp bushing.

* * * * *